US010355385B1

(12) United States Patent
Bulmer et al.

(10) Patent No.: US 10,355,385 B1
(45) Date of Patent: Jul. 16, 2019

(54) HIGH RELIABILITY ZERO INSERTION FORCE CONNECTOR AND ASSEMBLY

(71) Applicant: Miraco, Inc., Manchester, NH (US)

(72) Inventors: Douglas Bulmer, East Hampstead, NH (US); Jonathan Roberts, Canaan, NH (US)

(73) Assignee: Miraco, Inc., Manchester, NH (US)

( * ) Notice: Subject to any disclaimer, the term of this patent is extended or adjusted under 35 U.S.C. 154(b) by 0 days.

(21) Appl. No.: 16/047,876

(22) Filed: Jul. 27, 2018

(51) Int. Cl.

| | |
|---|---|
| ***H01R 12/88*** | (2011.01) |
| ***H01R 13/11*** | (2006.01) |
| ***H01R 13/03*** | (2006.01) |
| ***H01R 12/79*** | (2011.01) |

(52) U.S. Cl.
CPC ..... *H01R 12/88* (2013.01); *H01R 12/79* (2013.01); *H01R 13/03* (2013.01); *H01R 13/112* (2013.01)

(58) Field of Classification Search
CPC ..... H01R 13/112; H01R 12/79; H01R 12/88
See application file for complete search history.

(56) References Cited

U.S. PATENT DOCUMENTS

| | | | | |
|---|---|---|---|---|
| 6,447,305 | B1 * | 9/2002 | Roberts | H01R 12/774 439/260 |
| 6,478,597 | B1 * | 11/2002 | Roberts | H01R 12/79 439/260 |
| 7,621,768 | B2 * | 11/2009 | Suzuki | H01R 12/73 439/260 |
| 8,845,358 | B2 * | 9/2014 | Kitagawa | H01R 13/627 439/357 |
| 2002/0187674 | A1 * | 12/2002 | Hirose | H01R 12/7005 439/495 |
| 2018/0323546 | A1 * | 11/2018 | Ikegami | H01R 12/79 |

FOREIGN PATENT DOCUMENTS

| | | | | |
|---|---|---|---|---|
| JP | 2016171029 A | * | 9/2016 | H01R 12/721 |

* cited by examiner

*Primary Examiner* — Briggitte R. Hammond
(74) *Attorney, Agent, or Firm* — Catherine Napjus; Michael Persson; Chisholm, Persson & Ball, PC

(57) ABSTRACT

This invention is a means for interconnecting a Flexible Printed Circuit (FPC) or Flat Flexible Cable (FFC) with a Printed Circuit Board (PCB) using a Zero Insertion Force (ZIF) style interconnection system. It features a high reliability contact structure providing a Normally Closed (NC) contact configuration which is always engaged unless deactivated by means of a movable actuator.

19 Claims, 10 Drawing Sheets

82
84

80
78

20
A
A
OPEN POSITION STOP
OPEN POSITION DETENT
74
CLOSED POSITION DETENT
76
TAPERED ENTRY FOR EASE OF ASSEMBLY
84

SLIDE RAIL FOR VERTICAL POSITIONING OF ACTUATOR
PIVOT
82

82

OPEN POSITION
88
CONTACT RELEASE RAMP
92
CLOSED (UNLOADED) POSITION
90
92
SECTION A-A SCALE 10:1

INSULATING RIB
80
CONTACT SLOT
78

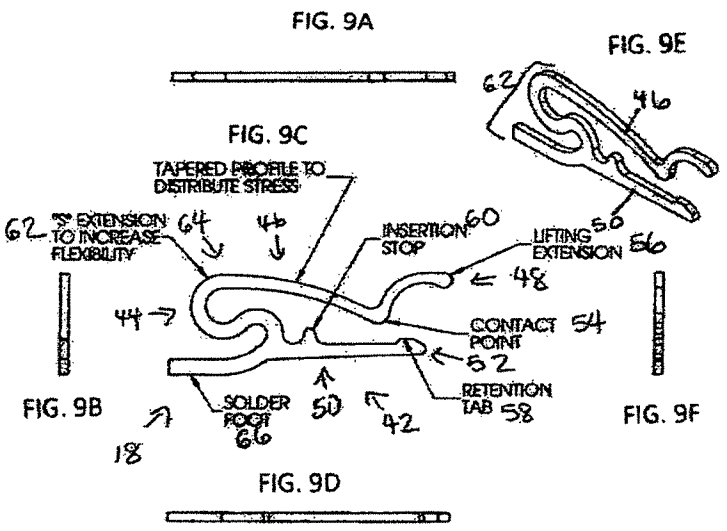
FIG. 9A
FIG. 9B
FIG. 9C
FIG. 9D
FIG. 9E
FIG. 9F
TAPERED PROFILE TO DISTRIBUTE STRESS
EXTENSION TO INCREASE FLEXIBILITY
INSERTION STOP
LIFTING EXTENSION
CONTACT POINT
RETENTION TAB
SOLDER FOOT
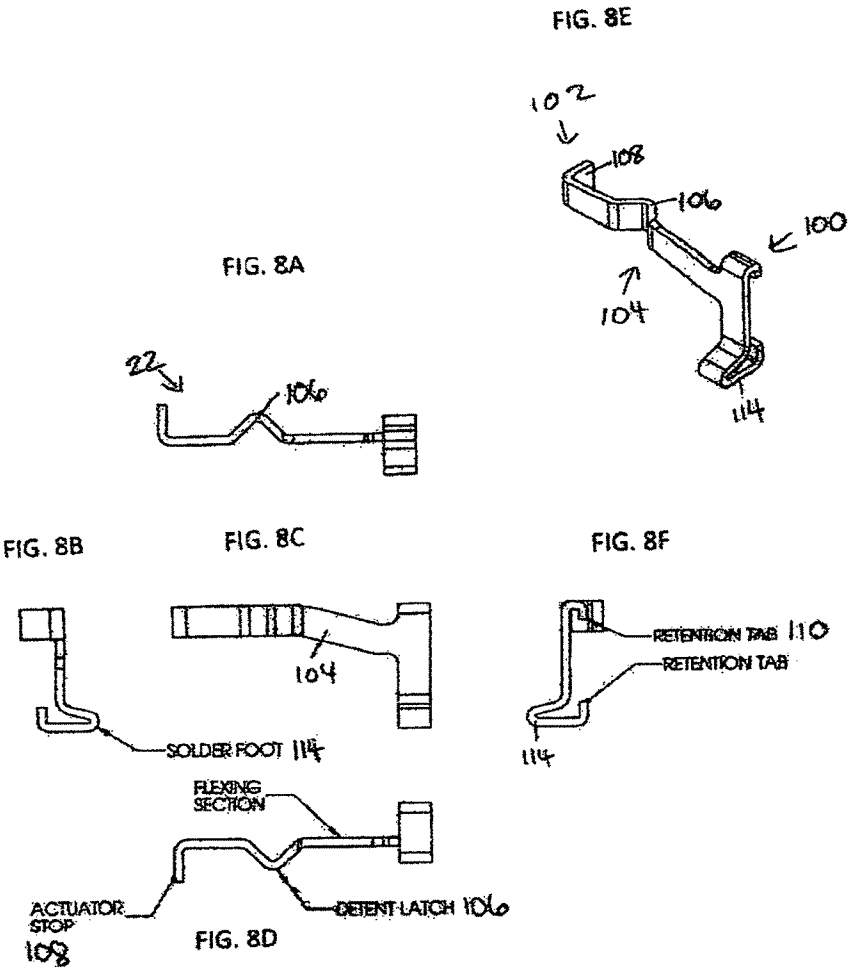
FIG. 8A
FIG. 8B
FIG. 8C
FIG. 8D
FIG. 8E
FIG. 8F
RETENTION TAB
SOLDER FOOT
FLEXING SECTION
DETENT LATCH
ACTUATOR STOP

HIGH RELIABILITY ZERO INSERTION FORCE CONNECTOR AND ASSEMBLY

CLAIM OF PRIORITY

This application claims the benefit of priority of U.S. Provisional Patent Application Ser. No. 62/537,983, filed on Jul. 28, 2017.

FIELD OF THE INVENTION

The present invention relates to the field of multiple-conductor Flexible Printed Circuits (FPCs), Flat Flexible Cables (FFCs), and Zero Insertion Force (ZIF) style electrical connectors used for interconnecting said circuits with other electrical devices.

BACKGROUND

Today's market for mobile electronics has driven connector manufacturers to push the limits of miniaturization to produce smaller and smaller connectors for FPC and FFC. These miniaturized connectors use thinner plastics and smaller contacts and achieve lower contact forces. As a result, a segment of the market has been left out which is those manufacturers whose product's primary requirement is ruggedness and reliability. These products are generally in the military, aviation, medical, and automotive markets.

ZIF style interconnects have several benefits. First, when an FPC or FFC is inserted into or removed from the connector, there is no wiping of the contact and conductor surface which results in less surface plating wear compared to non-ZIF style connectors. This makes the connectors particularly suited to gold-plated contacts which do not require contact wiping to remove surface oxidation from the contact surfaces. Using gold-plated contacts requires less contact force for a reliable connection so contacts and connectors may be reduced in size compared to contacts with tin or nickel plating. Also, since there is no contact wipe, and therefore very little wear on the contact surface, the contacts are suitable for multiple insertion and extraction cycles.

Due to their reduced size, modern ZIF connectors use minimal contact force to make an electrical connection. They also have a very small allowable deflection range, which is typically only a few thousandths of an inch, to achieve the industry accepted standard contact force for gold-plated electrical contacts of 30 grams nominal with 10 grams minimum. With such a small deflection range, and when the FPC or FFC are at the minimum thickness tolerance, the connection may not provide the minimum contact force. As a result, these connectors are more prone do discontinuity in environments where the connector will be subject to shock and vibration conditions which may induce motion and cause the contact to deflect.

ZIF connectors use a Normally Open (NO) contact configuration which uses either a rotating or sliding actuator to reduce the contact gap which applies pressure to engage the contact with the FPC or FFC to make the electrical contact. The contact only provides the proper contact force when this actuator is fully engaged. Any movement or disengagement of the actuator induced by shock or vibration may disengage the contact from the FPC or FFC and cause an electrical discontinuity. This feature is what makes ZIF connectors inherently poorly suited to conditions with high shock and vibration. Also, in some designs, any significant movement of the FFC or FPC can dislodge the actuator which releases the contact pressure and causes an electrical discontinuity. This is commonly addressed by having to incorporate additional hardware to fix the FFC or FPC in position outside the connector to provide strain relief.

SUMMARY OF THE INVENTION

The present invention is a ZIF connector assembly for use with FPCs or FFCs. The present invention solves the reliability issue by using a Normally Closed (NC) contact design. In order to insert into or extract an FPC or FFC from the connector, the contact must first be opened by means of engaging a sliding or rotating actuator with the contact. Once opened, the FPC or FFC may be inserted or removed with ZIF. After insertion, the actuator is returned to and locked into its rest position which allows the contact to make connection with the FPC or FFC. The FPC or FFC with which the connector assembly is used include a plurality of preferably metallic conductors. In its most basic form, the connector assembly includes a housing, a plurality of electrically conductive contacts, an actuator, and at least one latch. The housing retains and positions the contacts in a configuration in alignment with the conductors of the FPC or FFC. It is preferred that the FPC or FFC containing the plurality of metallic conductors contain the conductors in a parallel configuration that is mirrored in the housing with contacts in a parallel configuration to facilitate the alignment. It is noted that although the termination points of conductors or pads may be staggered, the configuration is still parallel.

The housing is approximately box-shaped. It includes a front section with a cable entry slot. The entry slot is sized and dimensioned to allow the insertion and/or extraction of the FPC or FFC with ZIF. The entry slot fully surrounds the FPC or FFC terminal, thus preventing vertical motion of the cable that could affect contact force between the FPC or FFC conductors and the connector assembly contacts. First and second sides of the housing extend perpendicularly back from either side of the front section of the housing. A base including contact slots is disposed in the space between the front section and the two sides. The contact slots are a series of parallel openings separated by ribs, where the contact slots open toward a back section of the housing. As discussed below, the plurality of contacts is disposed within the contact slots, with the ribs guiding the contacts into the slots. These contact slots also control the motion of the actuator. In keeping with the approximation of the housing being box-shaped, it is open at the top (parallel to the base) and the back (parallel to the front section).

The housing is preferably made of an electrically insulating material, such as injection molded plastic. The housing is preferably manufactured by injection molding or additive manufacturing, such as three-dimensional printing. Toward the front section of the housing, the base preferably includes a contact retention latch, which engages with contact retention tabs on the contacts, as discussed below.

The plurality of electrically conductive contacts forms an electrical connection when aligned and brought in physical contact with the plurality of conductors of the FPC or FFC. Each of the plurality of contacts is positioned within a contact slot of the housing, as discussed above. These contact slots hold the contacts in position so that the contacts will come into physical contact with the FPC or FFC conductors when the FPC or FFC is inserted into the entry slot of the housing. The contacts are preferably made of a metallic material with high electrical conductivity and good mechanical strength. Non-limiting examples of materials out of which the contacts may be made include phosphor bronze, beryllium copper, bronze, and brass. The contacts are preferably made by stamping, forming, or a combination of stamping and forming. It is preferred that the contacts are entirely covered by metallic surface plating to aid in solder wetting and to prevent corrosion. The metallic surface plating is preferably gold, silver, nickel, tin, or a combination thereof, or another alloy that will aid in soldering the contact and in oxidation prevention.

Although the contact may be shaped in any way so that some portion of it will be brought into contact with the conductor when the FPC or FFC is inserted into the entry slot, it is preferred that each contact have a modified U-shape, where the rounded side of the U-shape is the rounded section, and the sides of the U-shape are a top side with a top end and a bottom side with a bottom end. When the FPC or FFC is inserted into the entry slot of the housing, it will be disposed between the top and bottom sides of the U-shape of the contact.

It is preferred that the top side of the U-shape continue a curvature from the rounded section, curving toward the front section of the housing and the bottom side of the U-shape, but without reaching the bottom side, into a contact point and then curving up again from the contact point so that the top end is a lifting extension. The contact point is preferably the point that will come in physical contact with the conductors of the inserted FPC or FFC. As explained below with reference to the actuator, the lifting extension will engage the actuator ramp as the actuator moves between open and closed positions.

It is preferred that the bottom side of the U-shape be relatively flat and include the retention tab that engages with the housing's contact retention latch to hold the contact in place within the housing. The retention tab is preferably a small protrusion upward from the bottom side into the space between the top and bottom sides of the U-shape. The retention tab is preferably disposed toward the bottom end of the bottom side. Between the bottom end of the bottom side and the rounded section, the bottom side preferably also includes an insertion stop that keeps the contact from travelling too far into the contact slots of the housing. The insertion stop is preferably another small protrusion upward from the bottom side into the space between the top and bottom sides of the U-shape. The insertion stop is another feature that holds that contacts in the correct position relative to the housing.

It is preferred that the rounded section of the U-shape be exaggerated into an S-shape. The S-shape of the rounded portion continuing into the top side of the U-shape creates an extended flexible arm, which effectively increases the overall length of the contact without increasing the horizontal length of the contact. This additional length reduces stress and provides for a more consistent contact force over a wider deflection range. The extended flexible arm acts as a spring to control contact force with the conductors of the FPC or FFC.

It is preferred that the contact also include a lead or solder foot extending back from the bottom side of the U-shape and below the rounded section of the U-shape. In some embodiments of the connector assembly listed above are disposed on a PCB or FPC. In such embodiments, the contact's lead or solder foot is affixed to the PCB or FPC, preferably by soldering.

The actuator of the present invention is preferably made of an electrically insulating material, such as injection molded plastic. The actuator is preferably made by injection molding or additive manufacturing, such as three-dimensional printing. The actuator is disposed within the housing in the space created by the front section, the two sides, and the base of the housing. The actuator may move between an open position and a closed position. In the open position, the FPC or FFC may be inserted or extracted. In the closed position, either no FPC or FFC is inserted into the cable entry slot or an FPC or FFC is inserted in the cable entry slot and held there. The actuator includes a wedge-shaped ramp section, at least two detents, contact slots and ribs, pivot points, and a rotator.

The wedge-shaped ramp section is positioned toward the front section of the housing when the actuator is situated in the housing. The ramp section includes an open notch, a closed notch, and a release slope between the open and closed notches. It is preferred that the release slope upward from the closed notch to the open notch. As discussed above, the lifting extension at the top end of the top side of the U-shape of each contact moves along the ramp section of the actuator. When the actuator is in the open position, the lifting extension rests in the open notch of the ramp section of the actuator. When the actuator is in the closed position, the lifting extension rests in the closed notch of the ramp section of the actuator. The lifting extension slides along the release slope of the ramp section of the actuator to move between the open and closed notches, as the actuator moves between the open and closed positions, respectively.

The sides of the actuator are just within the sides of the housing. Each side of the actuator has at least two detents, corresponding to the open and closed positions of the actuator. The open position detent is closer to the front section of the housing. The closed position detent is behind the open position detent. As discussed below, latches on either side of the housing include a protrusion that is sized and dimensioned to mate with the detents of the actuator. When the latch protrusion is positioned in the open position detent, the actuator is in the open position. When the latch protrusion is positioned in the closed position detent, the actuator is in the closed position.

The contact slots and ribs of the actuator are similar to those of the housing. Their purpose is to guide and position the contacts as the contacts move between the open and closed positions with the actuator. Like the ribs of the housing, the ribs of the actuator are preferably made of an insulating material.

The pivot points of the actuator are for engagement with the rotator. The pivot points are essentially pins protruding from either side of the actuator toward the open back section of the housing. The pivot points are preferably tapered for ease of attaching the rotator. The rotator includes a handle and a pivot and cam lobe on either side of the handle. The handle traverses the back portion of the housing, running between the housing's two sides and across the width of the actuator. On either side of the handle is a pivot, which is a round opening, sized and dimensioned to mate with the pivot points of the actuator. The preferred tapering of the pivot points is to facilitate positioning the pivot points within the rotator's pivots. The cam lobes are protrusions out from the pivots, at an angle from the handle. The angle is preferably approximately 90°. When the handle is pressed down, the cam lobes are shifted forward, the actuator is shifted back, the lifting extension of each contact is forced from the closed notch, up the release slope, into the open notch, and the actuator is in an open position. In short, the cam lobes translate the rotary motion of the rotator into the linear motion of the remainder of the actuator. Conversely, lifting the handle of the rotator rotates the cam lobes back and the actuator is moved into the closed position. The actuator requires constant force to be applied by the user in order for the contacts to remain open during FPC or FFC insertion/extraction. In preferred embodiments, the actuator then automatically returns to the closed position when the applied force is removed in order to prevent the contacts from accidentally opening during use. In some embodiments, however, a user must manually close the actuator to the point of latching.

Finally, the connector assembly includes at least one latch disposed on either side of the housing. Each latch includes a first end disposed toward the front section of the housing, a second end disposed toward the back section of the housing, and a flexing section disposed between the first and second ends. As discussed above, each latch includes a protrusion that protrudes in toward the housing and mates with the open and closed position detents of the actuator. The protrusions are included on the flexing section of the latch. Indeed it is the flexibility of the flexing section that allows the protrusion to move between the open and closed position detents. The latches preferably include an actuator stop at the second end of the latches. The actuator stops are essentially lips extending in toward the housing that do not allow the actuator to come out of the housing after assembly. In preferred embodiments, the flexing section provides sufficient spring force to automatically return the actuator to the closed position, rather than requiring the manual repositioning of the handle of the rotator.

The latches preferably also include a housing retention tab and a latch foot disposed at the first end of the latches. In embodiments that include a housing retention tab, the housing also includes a latch retention pocket. In these embodiments, the housing retention tab is preferably a hook that catches the latch retention pocket so that the latch and the housing are held together. The latch foot is included in embodiments of the present invention where the housing is disposed on a PCB or FPC. The latch foot is affixed to the PCB or FPC under the housing. This affixation is preferably through soldering. It anchors the assembly to the PCB or FPC and provides strain relief. Some embodiments of the present invention include a latch foot that is independent of the latch. In other words, in some embodiments, the "latch" foot is a misnomer because it is a stand-alone part that is not actually incorporated into the latch.

The latches are preferably made of a metallic material with high electrical conductivity and good mechanical strength. Non-limiting examples of materials out of which the latches may be made include phosphor bronze, beryllium copper, bronze, and brass. The latches are preferably made by stamping, forming, or a combination of stamping and forming. It is preferred that the latches are entirely covered by metallic surface plating to aid in solder wetting and to prevent corrosion. The metallic surface plating is preferably gold, silver, nickel, tin, or a combination thereof, or another alloy that will aid in soldering the contact and in oxidation prevention.

These aspects of the present invention are not meant to be exclusive and other features, aspects, and advantages of the present invention will be readily apparent to those of ordinary skill in the art when read in conjunction with the following description and accompanying drawings.

BRIEF DESCRIPTION OF THE DRAWINGS

FIG. 8A is a top down view of the latch of the connector assembly.

FIG. 8B is a back view of the latch of the connector assembly.

FIG. 8C is a right side view of the latch of the connector assembly.

FIG. 8D is a bottom up view of the latch of the connector assembly.

FIG. 8E is a perspective view of the latch of the connector assembly.

FIG. 8F is a front view of the latch of the connector assembly.

FIG. 9A is a top down view of the latch of the connector assembly.

FIG. 9B is a back view of the latch of the connector assembly.

FIG. 9C is a right side view of the latch of the connector assembly.

FIG. 9D is a bottom up view of the latch of the connector assembly.

FIG. 9E is a perspective view of the latch of the connector assembly.

FIG. 9F is a front view of the latch of the connector assembly.

DETAILED DESCRIPTION

Figure 1:
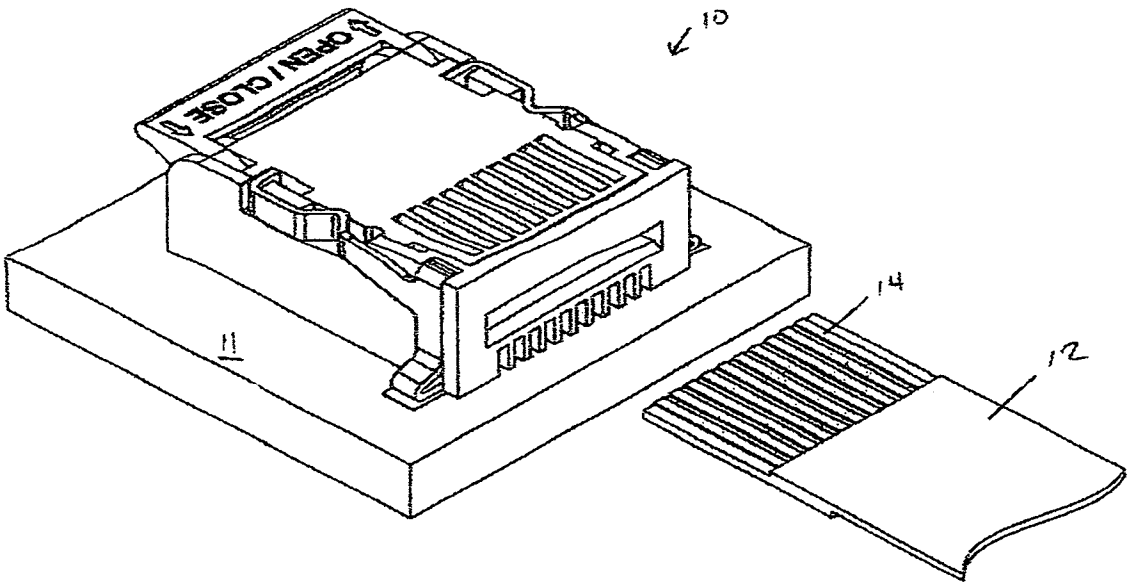
FIG. 1 is a perspective view of the preferred embodiment of the connector assembly of the present invention mounted on a PCB with an FPC or FFC to be inserted.

Referring first to FIG. 1 a perspective view of the preferred embodiment of the connector assembly 10 of the present invention mounted on a PCB 11 with an FPC or FFC 12 with conductors 14 to be inserted is provided. As used herein, FPC and FFC are collectively referred to as "flat male connectors." It is understood that PCB 11 may be replaced by an FPC and that the terms PCB and FPC are collectively referred to herein as "printed circuit."

Figure 2B:
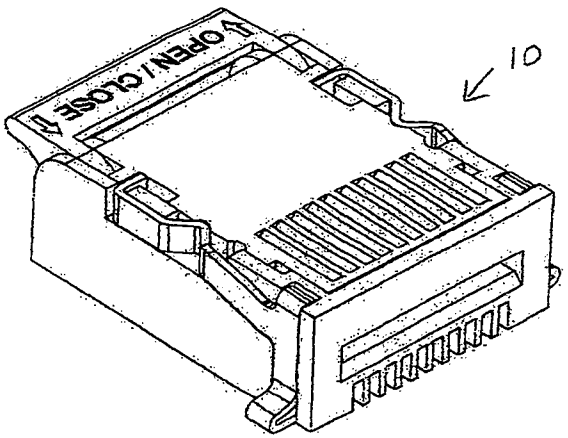
FIG. 2B is a perspective view of the connector assembly.
Figure 2A:
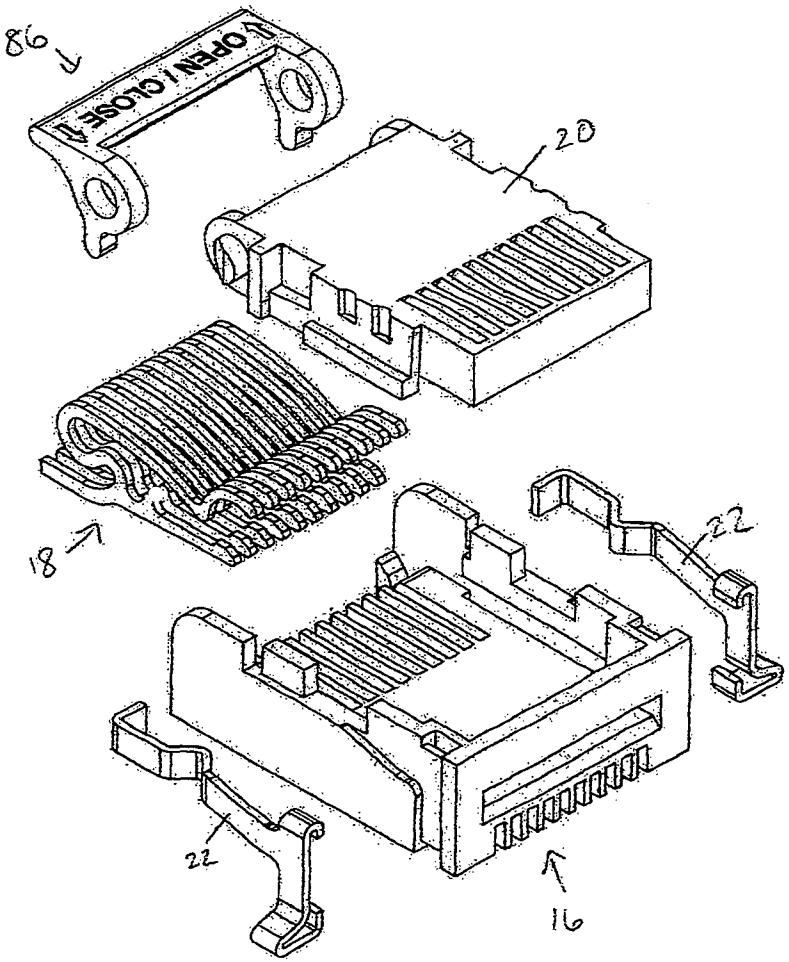
FIG. 2A is a perspective view of the connector assembly with the components separated for illustrative purposes.
Figure 2C:
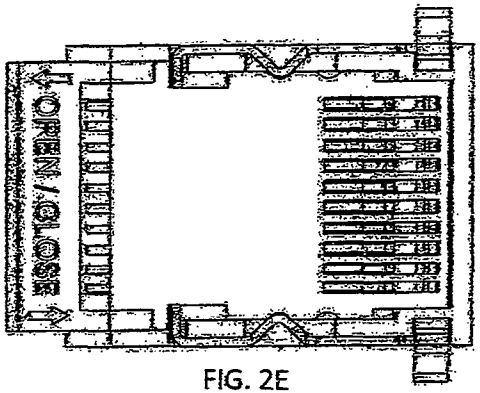
FIG. 2C is a top view of the connector assembly.
Figure 2E:
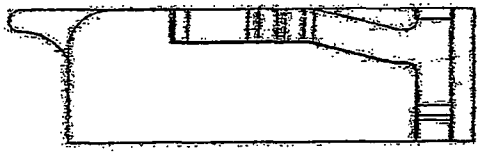
FIG. 2E is a right side view of the connector assembly.
Figure 2F:
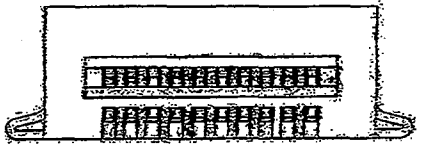
FIG. 2F is a front view of the connector assembly.
Figure 2G:
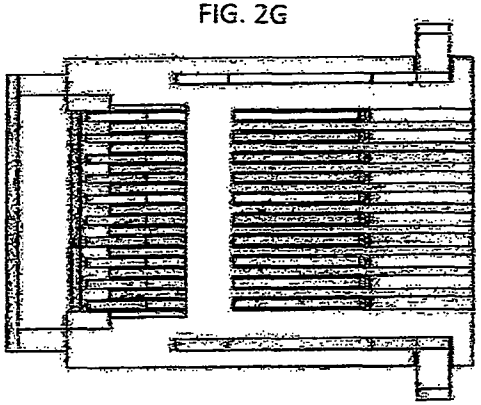
FIG. 2G is a bottom view of the connector assembly.
Figure 2D:
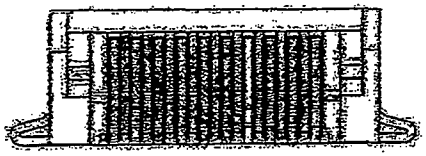
FIG. 2D is a back view of the connector assembly.

Now referring to FIG. 2A, a perspective view of the connector assembly 10 with the components separated for illustrative purposes is provided. Connector assembly 10 includes housing 16, contacts 18, actuator 20 with rotator 86, and latches 22. Each of these components will be described in more detail below. Now referring to FIGS. 2B-2F, perspective, top down, back, right side, front, and bottom up views of the connector assembly, respectively, are provided. Although a latch 22 is shown on either side of housing 16, it is understood that some embodiments of the present invention may include only one latch 22.

Figure 3A:
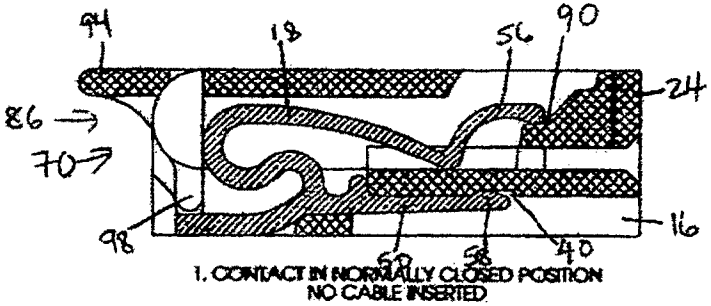
FIG. 3A is a side cutaway view of the connector assembly with the actuator in the closed position with no cable inserted.
Figure 3B:
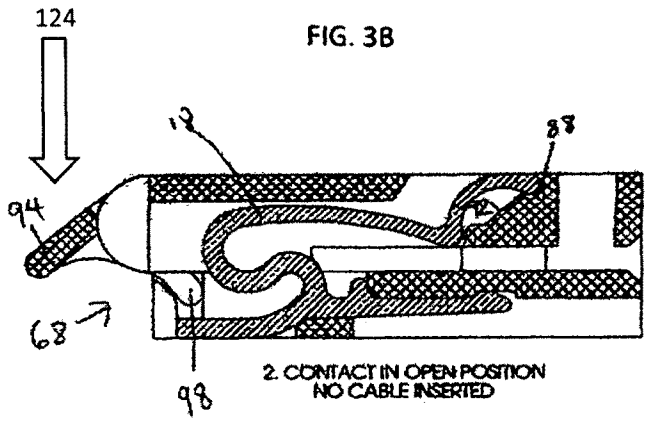
FIG. 3B is a side cutaway view of the connector assembly with the actuator in the open position with no cable inserted.
Figure 3C:
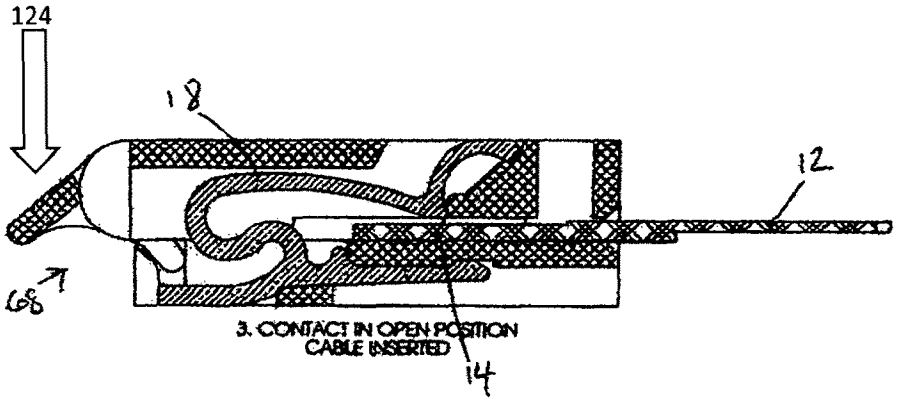
FIG. 3C is a side cutaway view of the connector assembly with the actuator in the open position with a cable inserted.
Figure 3D:
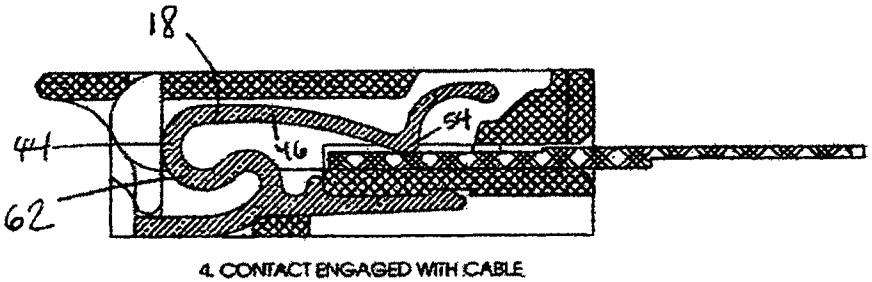
FIG. 3D is a side cutaway view of the connector assembly with the actuator engaged with a cable inserted.

Now referring to FIGS. 3A-3B, side, cutaway views of the connector assembly 10 with the actuator 20 in the closed position 70 with no cable 12 inserted; in the open position 68 with no cable 12 inserted; in the open position 68 with a cable 12 inserted; and engaged with a cable 12 inserted, respectively, are provided. In FIG. 3A, actuator 20 is in closed position 70. That is to say that rotator 86 is positioned such that cam lobe 98 is parallel with front section 24 of housing 16. In this closed position 70, lifting extension 56 of contact 18 rests in closed notch 90. In FIG. 3B, actuator 20 is in open position 68. That is to say that handle 94 of rotator 86 has been pressed down, i.e. force 124 has been applied as indicated by the downward arrow, pushing cam lobe 98 forward and pulling actuator 20 back. The rotation of rotator 86 translates into the lateral movement of actuator 20. As handle 94 is depressed with the application of force 124, lifting extension 56 will traverse up release slope 92 and come to rest in open notch 88. As shown in FIG. 3C, this open position 68 allows for the insertion of the flat male connector 12 with conductors 14. In FIG. 3D, handle 94 is again raised by removing force 124 so that contact point 54 of contact 18 is brought into physical contact with conductors 14. Removing force 124 allows actuator 20 to automatically return to closed position 70. The flexibility of top side 46 provided by the S-shape 62 of the rounded side 44 allow for a consistent contact force of contacts 18 on conductors 14. Note that in each of FIGS. 3A-3D, contact retention tab 58 of bottom side 50 of contact 18 is held in place with respect to housing 16 by contact retention latch 40.

Figure 10A:
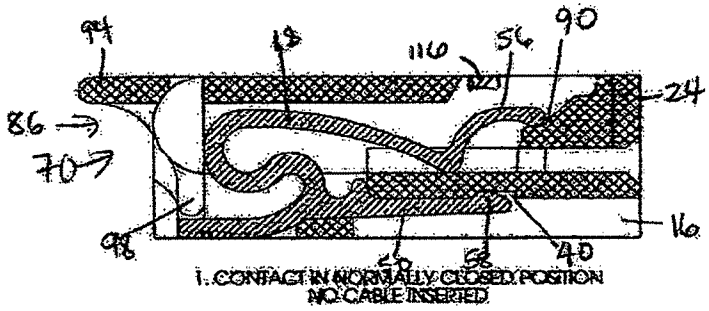
FIG. 10A is a side cutaway view of the connector assembly having a spring member with the actuator in the closed position with no cable inserted.
Figure 10B:
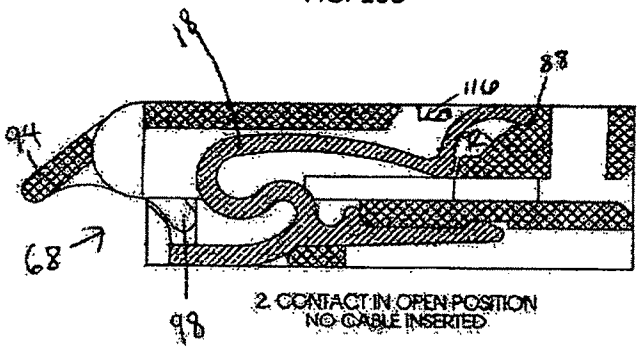
FIG. 10B is a side cutaway view of the connector assembly having a spring member with the actuator in the open position with no cable inserted.
Figure 10C:
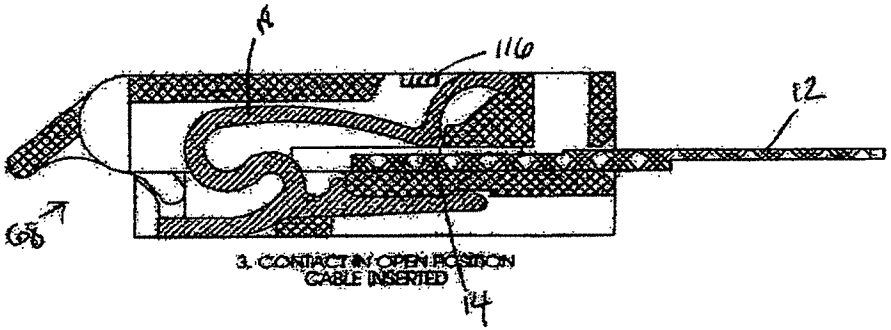
FIG. 10C is a side cutaway view of the connector assembly having a spring member with the actuator in the open position with a cable inserted.
Figure 10D:
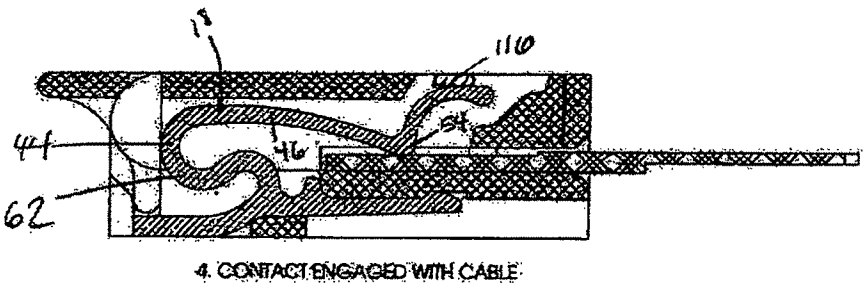
FIG. 10D is a side cutaway view of the connector assembly having a spring member with the actuator engaged with a cable inserted.

The assembly of FIGS. 3A-3B are preferred when contact 18 is manufactured from a high quality spring grade beryllium copper material, as this material provides sufficient downward force on the conductors 14. However, in other embodiments, such as those shown in FIGS. 10A-10-D, an additional spring member 116 is disposed across the inside of the actuator. This spring member 116 is located at a position on the actuator such that it spans all contacts 18 but only engages the contacts 18 at each lifting extension 56 when the contact is engaged with a cable 12 and the connector is in a closed position, as shown in FIG. 10D. The spring member 116 is preferably a leaf type spring and is manufactured from a material that provides a desired additional downward force upon each contact 18.

Figure 4B:
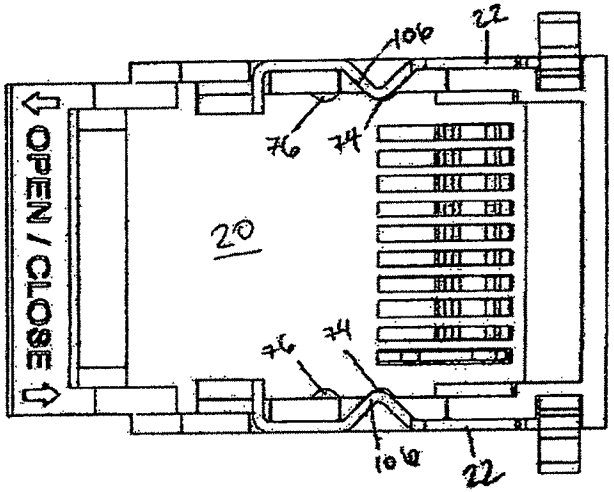
FIG. 4B is a right side top down view of the connector assembly with the actuator in the closed position.
Figure 4D:
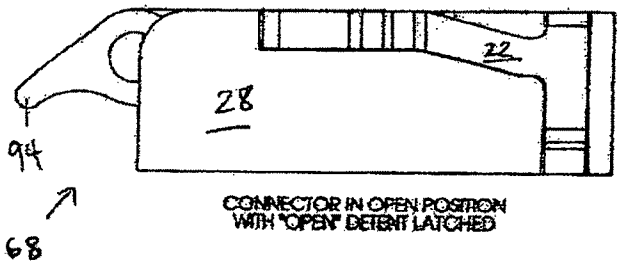
FIG. 4D is a right side view of the connector assembly with the actuator in the open position.
Figure 4A:
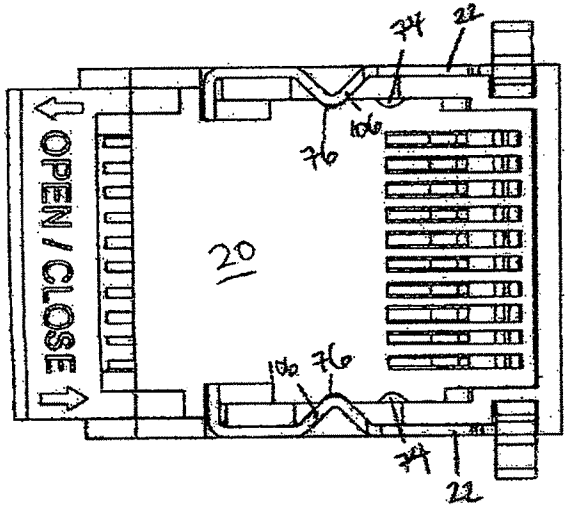
FIG. 4A is a top down view of the connector assembly with the actuator in the closed position.

Now referring to FIGS. 4A and 4B, top down and right side views, respectively, of the connector assembly 10 with the actuator 20 in the closed position 70 are provided. Protrusion 106 of latch 22 is positioned in closed detent 76 of actuator 20. In FIG. 4B, we see first side 28 of housing 16 and latch 22, with handle 94 of rotator 86 in the closed position 70.

Figure 4C:
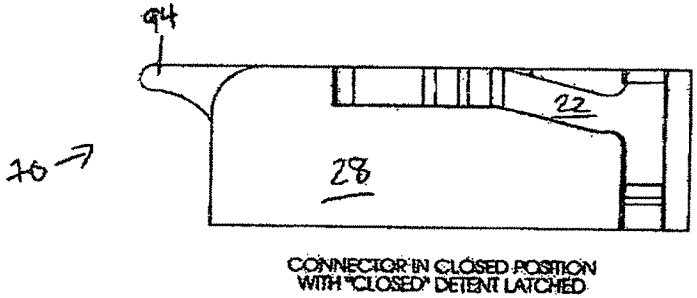
FIG. 4C is a top down view of the connector assembly with the actuator in the open position.
Figure 5F:
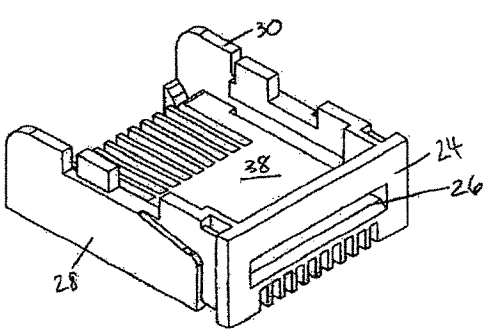
FIG. 5F is a perspective view of the housing of the connector assembly.
Figure 5C:
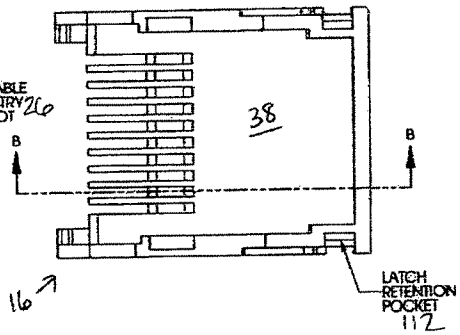
FIG. 5C is a top down view of the housing of the connector assembly.
Figure 5A:
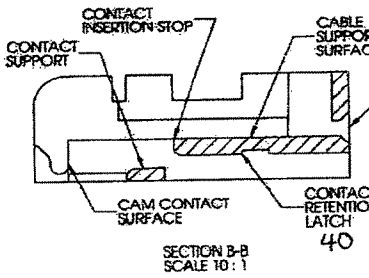
FIG. 5A is a right side cutaway view of the housing of the connector assembly.
Figure 5G:
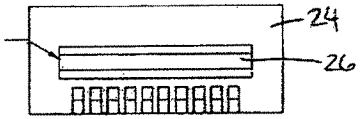
FIG. 5G is a front view of the housing of the connector assembly.
Figure 5D:
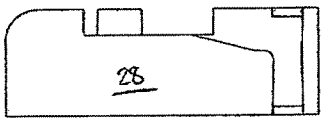
FIG. 5D is a right side view of the housing of the connector assembly.
Figure 5B:
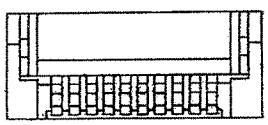
FIG. 5B is a back view of the housing of the connector assembly.
Figure 5E:
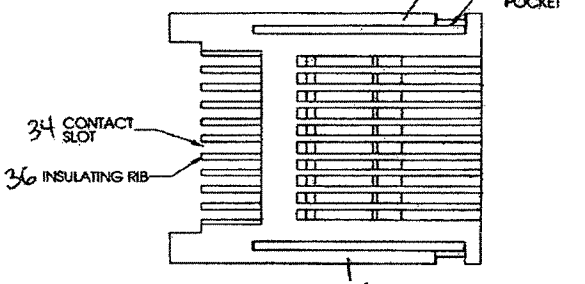
FIG. 5E is a bottom up view of the housing of the connector assembly.

Now referring to FIGS. 4C and 4D, top down and right side views, respectively, of the connector assembly 10 with the actuator 20 in the open position 68 are provided. Protrusion 106 of latch 22 is position in open detent 74 of actuator 20. In FIG. 4D, we again see first side 28 of housing 16 and latch 22, but this time handle 94 is depressed in the open position 68.

Now referring to FIGS. 5A-5G, right side cutaway, back, top down, right side, bottom up, perspective, and front views, respectively, of the housing 16 of the connector assembly 10 are provided. Housing 16 has front section 24 with entry slot 26; first side 28 parallel to second side 30, each on either side of front section 24; base 38 taking up the space defined by front section 24, first side 28, and second side 30; and back section 38. Base 32 includes contact slots 34 separated by ribs 36. Each side 28, 30 includes a latch retention pocket 112 for holding latch 22 in place with respect to housing 16. FPC or FFC 12 will enter entry slot 26.

Figures 6A, 6B, 6C, 6D, 6E, 6F, 6G:
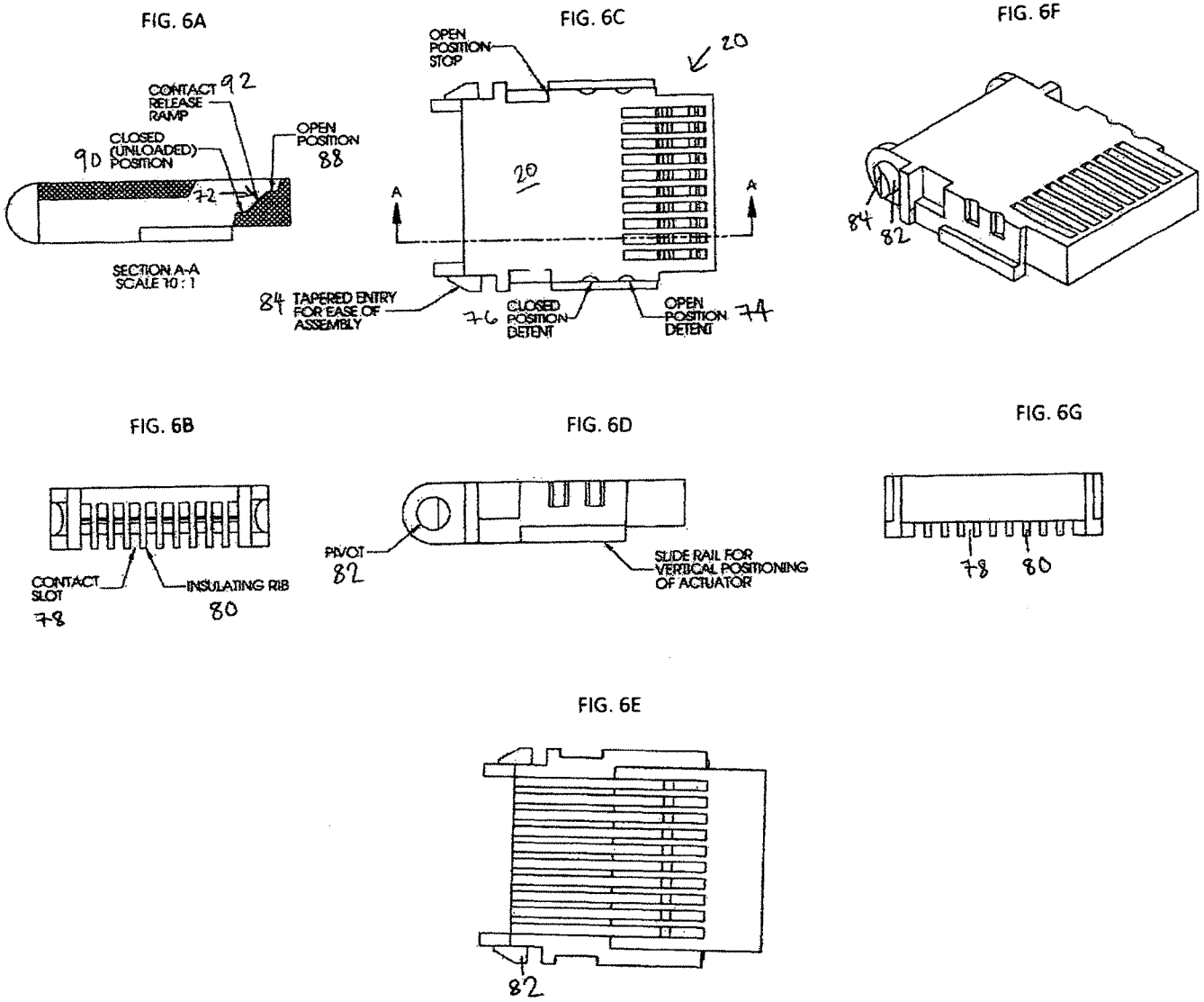
FIG. 6A is a right side cutaway view of the of the actuator of the connector assembly without the rotator.
FIG. 6B is a back view of the housing of the of the actuator of the connector assembly without the rotator.
FIG. 6C is a top down view of the housing of the of the actuator of the connector assembly without the rotator.
FIG. 6D is a right side view of the housing of the of the actuator of the connector assembly without the rotator.
FIG. 6E is a bottom up view of the housing of the of the actuator of the connector assembly without the rotator.
FIG. 6F is a perspective view of the housing of of the actuator of the connector assembly without the rotator.
FIG. 6G is a front view of the housing of the of the actuator of the connector assembly without the rotator.
Figure 7E:
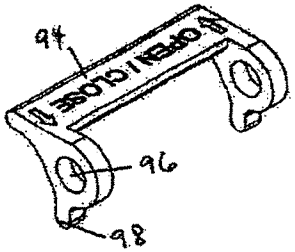
FIG. 7E is a perspective view of the rotator of the actuator of the connector assembly.
Figure 7F:
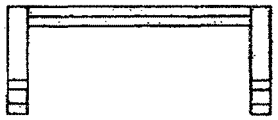
FIG. 7F is a front view of the rotator of the actuator of the connector assembly.
Figure 7A:
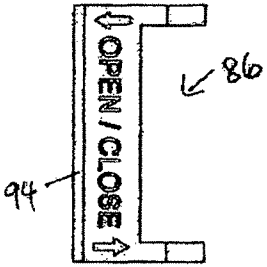
FIG. 7A is a top down view of the rotator of the actuator of the connector assembly.
Figure 7C:
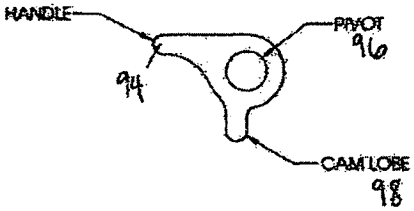
FIG. 7C is a right side view of the rotator of the actuator of the connector assembly.
Figure 7D:
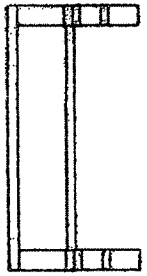
FIG. 7D is a bottom up view of the rotator of the actuator of the connector assembly.
Figure 7B:
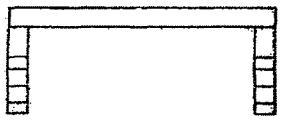
FIG. 7B is a back view of the rotator of the actuator of the connector assembly.

Now referring to FIGS. 6A-6G, right side cutaway, back, top down, right side, bottom up, perspective, and front views, respectively, of the actuator 20 of the connector assembly 10 without the rotator 86 are provided. As shown in FIG. 6A, actuator 20 includes ramp section 72. Ramp section 72 includes open notch 88, closed notch 90, and release slope 92. As described with respect to FIGS. 3A-3D, lifting extension 56 of top end 48 of the U-shape 42 of contacts 18 will engage open notch 88, closed notch 90, and release slope 92 while actuator 20 moves between open position 68 and closed position 70. Like housing 16, actuator 20 also includes contact slots 78 and ribs 80 to guide contacts 18. As described with respect to FIGS. 4A-4D, actuator 20 also includes open and closed detents 74, 76 which are engaged by protrusion 106 of latch 22 when actuator 20 is in open and closed positions 68, 70, respectively. Actuator 20 also includes pivot point 82 with taper 84 for ease of combination with pivot 96 of rotator 86, as described below with reference to FIGS. 7A-7F.

Now referring to FIGS. 7A-7F, top down, back, side, bottom up, perspective, and front views, respectively, of the rotator 86 of the actuator 20 of the connector assembly 10 are provided. Rotator 86 includes handle 94 connecting pivot 96 and cam lobe 98 on either side of handle 94. Pivot 96 is sized and dimensioned to accept pivot point 82, shown in FIGS. 6A-6G. Cam lobe 98 is preferably disposed at a 90° angle from handle 94.

Now referring to FIGS. 8A-8F, top down, back, side, bottom up, perspective, and front views, respectively, of the latch 22 of the connector assembly 10 are provided. Latch 22 includes first end 100, second end 102, and flexing section 104 between first and second ends 100, 102. First end 100 preferably includes retention tab 110 that mates with latch retention pocket 112 of housing 16 to secure latch 22 and housing 16 together. First end 100 also preferably includes latch foot 114, which is soldered to PCB or FPC 11. Second end 102 preferably includes actuator stop 108. Actuator stop 108 ensures that actuator 20 will stay within housing 16 once positioned therein. Flexing section 104 includes protrusion 106 that mates with either open or closed detent 74, 76 of actuator 20, depending on whether actuator 20 is in open or closed position 68, 70, respectively. The spring-like flexible nature of flexing section 106 allows for the movement of protrusion 106 between open and closed detents 74, 76.

Now referring to FIGS. 9A-9F, top down, back, side, bottom up, perspective, and front views, respectively, of the contact 18 of the connector assembly 10 are provided. It is understood that connector assembly 10 includes as many contacts 18 as the flat male connector 12 being connected to connector assembly 10 has conductors. FIG. 9A focus on a single contact 18, and it is understood that each contact 18 is similar. Contact 18 preferably has a distorted U-shape 42. This U-shape is discernible by rounded side 44 connecting top side 46 and bottom side 50. Top side 46 deviates from a standard U-shape in that it curves downward toward bottom side 50 and toward front section 24 of housing 16 to come to contact point 54, and then curves back up in lifting extension 56 to end in top end 48. As discussed above with respect to FIG. 3D, for example, contact point 54 is the point of contact between contact 18 and the corresponding conductor 14 of FPC or FFC 12. When inserted into entry slot 26 of housing 16, the conductors 14 of flat male connector 12 will be disposed between top and bottom sides 46, 50 of the U-shape 42 of contacts 18. The rounded side 44 of U-shape 42 deviates from a standard U-shape in that it forms an S-shape 62. This S-shape 62 increases the overall length of the rounded side 44 without increasing the horizontal length of contact 18. This additional length provides for a more consistent force over a wider deflection range. The bottom side 50 of the U-shape is fairly flat, but includes retention tab 58 and bottom end 52 and insertion stop 60 farther toward the rounded side 44. The retention tab 58 is a protrusion into the space between the top and bottom sides 46, 50 of the U-shape 42, which mates with the contact retention latch 40 of the housing 16, as shown in FIGS. 3A-3D, for example, to secure the contacts 18 to the housing 16. The insertion stop 60 is another protrusion into the space between the top and bottom sides 46, 50 of the U-shape 42. Insertion stop 60 prevents the contact 18 from travelling too far into the contact slots 34 of the housing 16. Finally, the U-shape 42 includes something of a tail in lead 66. Lead 66 is soldered to PCB or FPC 11. This ensures affixation of the contacts 18 to PCB/FPC 11.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

We claim:

1. A zero insertion force connector assembly for use with a flat male connector comprising a plurality of metallic conductors, said connector assembly comprising:

a housing comprising:

a plurality of housing contact slots;

an actuator ramp; and an entry slot sized and dimensioned to allow insertions and extraction of the flat male connector;

a plurality of electrically conductive contacts that form an electrical connection when aligned with the plurality of metallic conductors of the flat male connector, wherein one of said plurality of contacts is disposed within each one of said housing contact slots of said housing;

an actuator disposed within said housing, wherein:

said actuator is adjustable between an open position and a closed position;

said open position allows for the insertion of the flat male connector into and extraction of the flat male connector from said housing and allows for the electrical connection between the conductors of the flat male connector and said contacts;

said closed position retains the inserted flat male connector in place within said actuator; and said actuator comprises:

a plurality of actuator contact slots sized and dimensioned to accommodate said plurality of contacts and allow for a motion of said actuator around said plurality of contacts;

a plurality of actuator ramps over which said plurality of contacts disposed within said plurality of actuator contact slots slide between said open and closed positions of said actuator, wherein each of said plurality of actuator ramps comprises:

an open notch that engages said contact when said actuator is in said open position;

a closed notch that engages said contact when said actuator is in said closed position; and a slope between said open notch and said closed notch;

an open detent; and a closed detent;

at least one latch comprising a latch protrusion sized and dimensioned to engage said open detent and said closed detent of said actuator such that said latch holds said actuator in said open position when said latch protrusion engages said open detent of said actuator and holds said actuator in said closed position when said latch protrusion engages said closed detent of said actuator.

2. The connector assembly as claimed in claim 1, wherein the plurality of conductors of the flat male connector are disposed in a parallel configuration and said plurality of contacts are correspondingly disposed in a parallel configuration so as to facilitate the electrical connection formed between the conductors and said contacts.

3. The connector assembly as claimed in claim 1, wherein said contacts are made of one of a group consisting of phosphor bronze, beryllium copper, bronze, and brass.

4. The connector assembly as claimed in claim 1, wherein each of said contacts comprises a flexible arm that acts as a spring to control a force with which said contacts are in physical contact with the conductors of the flat male connector.

5. The connector assembly as claimed in claim 4, wherein each of said flexible arms comprises a lifting extension that is alternately engaged by said open and closed notches of said actuator ramp and that moves against said slope of said actuator ramp when said actuator moves between said open and closed positions.

6. The connector assembly as claimed in claim 4, wherein each of said flexible arms of said contacts comprises an S-shaped section.

7. The connector assembly as claimed in claim 1, wherein:
- each of said contact slots of said housing comprises a contact retention latch;
- each of said contacts comprises a retention tab;
- each of said retention tabs is sized and dimensioned to be caught and held by each of said contact retention latches; and
- when said contact retention latches and said retention tabs are aligned, said contacts are held in place within said housing.

8. The connector assembly as claimed in claim 1, further comprising insulating ribs separating each of said plurality of housing contact slots.

9. The connector assembly as claimed in claim 1, further comprising a printed circuit on which said housing is disposed and affixed, wherein:
- said latch is spring loaded and comprises:
  - a first end comprising a latch retention tab and a latch foot;
  - a second end; and
  - a latch flexible arm extending between said first end and said second end;
- said housing further comprises a latch retention pocket;
- said latch retention tab is sized and dimensioned to engage said latch retention pocket so that said latch and said housing are held together; and
- said latch foot is affixed to said printed circuit.

10. The connector assembly as claimed in claim 9, wherein said second end of said latch comprises an actuator stop that holds said actuator within said housing.

11. The connector assembly as claimed in claim 1, wherein said actuator is made of an electrically insulating material.

12. The connector assembly as claimed in claim 1, wherein said actuator further comprises:
- pivot points on either side of said actuator; and
- a rotator, comprising:
  - two rotating pivots sized and dimensioned to accommodate said pivot points; and
  - a handle connecting said rotating pivots, wherein each rotating pivot comprises a cam lobe disposed at an angle to said handle;
- wherein pushing said handle places said actuator in said open position.

13. The connector assembly as claimed in claim 5 further comprising a spring member disposed upon said actuator and located at a position upon said actuator such that said spring member spans all contacts but only engages said contacts at each of said lifting extensions of said contacts when said contacts are engaged with said flat male connector.

14. A zero insertion force connector for use with a flat male connector comprising a plurality of metallic conductors, said zero insertion force connector comprising:
- a housing, comprising:
  - a plurality of housing contact slots;
  - an actuator ramp; and
  - an entry slot sized and dimensioned to allow insertions and extraction of the flat male connector;
  - wherein each of said contact slots of said housing comprises a contact retention latch;
  - wherein each of said contacts comprises a retention tab;
  - wherein each of said retention tabs is sized and dimensioned to be caught and held by each of said contact retention latches; and
  - wherein said contacts are held in place within said housing when said contact retention latches and said retention tabs are aligned;
- a plurality of electrically conductive contacts that form an electrical connection when aligned with the plurality of metallic conductors of the flat male connector;
- an actuator disposed within said housing, wherein said actuator is adjustable between an open position and a closed position and is in a normally closed position such that said actuator may only be moved into an open position when a force is applied thereto and automatically returns to a closed position when a force is removed therefrom.

15. The zero insertion force connector as claimed in claim 14, wherein each of said contacts comprises a flexible arm that acts as a spring to control a force with which said contacts are in physical contact with the conductors of the flat male connector.

16. The zero insertion force connector as claimed in claim 15, wherein said actuator comprises:
- a plurality of actuator contact slots sized and dimensioned to accommodate said plurality of contacts and allow for a motion of said actuator around said plurality of contacts;
- a plurality of actuator ramps over which said plurality of contacts disposed within said plurality of actuator contact slots slide between said open and closed positions of said actuator, wherein each of said plurality of actuator ramps comprises:
  - an open notch that engages said contact when said actuator is in said open position;
  - a closed notch that engages said contact when said actuator is in said closed position; and
  - a slope between said open notch and said closed notch; and
- wherein each of said flexible arms comprises a lifting extension that is alternately engaged by said open and closed notches of said actuator ramp and that moves against said slope of said actuator ramp when said actuator moves between said open and closed positions.

17. The zero insertion force connector as claimed in claim 16 further comprising at least one latch comprising a latch protrusion sized and dimensioned to engage said open detent and said closed detent of said actuator such that said latch holds said actuator in said open position when said latch protrusion engages said open detent of said actuator and holds said actuator in said closed position when said latch protrusion engages said closed detent of said actuator.

18. The zero insertion force connector as claimed in claim 16, wherein said actuator further comprises:

pivot points on either side of said actuator; and a rotator, comprising:

two rotating pivots sized and dimensioned to accommodate said pivot points; and a handle connecting said rotating pivots, wherein each rotating pivot comprises a cam lobe disposed at an angle to said handle;

wherein pushing said handle places said actuator in said open position.

19. The zero insertion force connector as claimed in claim 16 further comprising a spring member disposed upon said actuator and located at a position upon said actuator such that said spring member spans all contacts but only engages said contacts at each of said lifting extensions of said contacts when said contacts are engaged with said flat male connector.

* * * * *